United States Patent [19]

Philipps et al.

[11] 4,253,796

[45] Mar. 3, 1981

[54] FAN OR BLOWER ASSEMBLY

[75] Inventors: Donald F. Philipps, Coon Rapids; Richard D. Williamson, Hugo, both of Minn.

[73] Assignee: The Marley-Wylain Company, Mission, Kans.

[21] Appl. No.: 940,121

[22] Filed: Sep. 6, 1978

[51] Int. Cl.[3] ..... F04D 29/46

[52] U.S. Cl. ..... 415/157; 415/201

[58] Field of Search ..... 415/126, 128, 157, 158, 415/201

[56] References Cited

U.S. PATENT DOCUMENTS

| | | | |
|---|---|---|---|
| 617,352 | 1/1899 | Randolph . | |
| 622,706 | 4/1899 | Nutt . | |
| 1,053,154 | 2/1913 | Campbell et al. | 415/157 |
| 1,326,673 | 12/1919 | Lepley | 415/157 |
| 1,846,379 | 2/1932 | Anderson | 415/157 |
| 2,504,714 | 4/1950 | McGehee | 34/136 |
| 3,173,478 | 3/1965 | Maycen | 165/121 |
| 3,576,263 | 4/1971 | Abendroth | 214/35 |
| 4,073,597 | 2/1978 | Barnhart et al. | 415/201 |

FOREIGN PATENT DOCUMENTS

| | | | |
|---|---|---|---|
| 564040 | 2/1958 | Belgium | 415/157 |
| 2656040 | 6/1978 | Fed. Rep. of Germany | 415/157 |

*Primary Examiner*—Louis J. Casaregola

*Attorney, Agent, or Firm*—Lane, Aitken, Ziems, Kice & Kananen

[57] ABSTRACT

A fan assembly, which includes a centrifugal-type fan wheel mounted for rotation in, e.g., a scroll-like fan casing or a tubular fan casing is provided with a retractable fan inlet funnel which may be selectively positioned relative to the fan wheel between an extended position and a retracted position. In the extended position, the inlet funnel axially overlaps the inlet side of the fan wheel with substantially all the inlet air being directed into the fan wheel. In the retracted position, the inlet funnel is spaced away from the fan wheel to permit a portion of the fan wheel outlet air to recirculate to the inlet side of the fan wheel. Fan performance characteristics including the static pressure, the volume flow rate, the selection of a stable air flow operating point, and the fan wheel power requirements are conveniently and advantageously controlled by adjusting the inlet funnel position.

In the preferred embodiment, the inlet funnel has a converging/diverging venturi shape and is movably connected to a truncated conical base by a linkage assembly. The assembly includes a plurality of links each of which has one end pivoted to the base and the other end pivotally connected to a support ring which is connected to the inlet funnel by struts. Pivotal movement of the links, either by a torque member or a lead-screw/-nut arrangement, causes the inlet funnel to change its position relative to the fan wheel and thereby vary the fan performance.

13 Claims, 8 Drawing Figures

FAN OR BLOWER ASSEMBLY

BACKGROUND OF THE INVENTION

The present invention relates to fan arrangements and, more particularly, to fan arrangements having increased overall efficiency and means to control the fan performance characteristics over a wide range by altering the inlet air flow to the fan wheel.

Air handling systems, such as those used in manufacturing facilities and buildings, usually employ large fans or blowers as part of the system. The essential elements of a typical fan include a centrifugal-type impeller or fan wheel mounted for rotation in a fan casing and a single speed motor for driving the fan wheel, generally through a 'V' velt and pulley arrangement. While the present invention is adapted for use with most, if not all, fan designs, it is particularly suited for use with those fan designs which have their rotating components mounted on a hinged door. These type of fan designs, known as "swing-out designs," include fans having a scroll-like fan casing in which the fan wheel axis of rotation is aligned along the horizontal and fans having a tubular fan casing in which the fan wheel axis of rotation is alinged along the vertical.

In the swing-out scroll fan design, a plate-like door is higned along one of its edges to the scroll-like fan casing and carries the fan wheel on one side of the door, a horizontally aligned mounting shaft which extends through the door, and the motor which drives the shaft through a 'V' belt and pulley arrangement. In the closed position, the door locates the fan wheel in the fan casing with the inlet side of the fan wheel in an axially overlapping relationship with an air inlet bell or funnel. Substantially all the inlet air is directed to the inlet side of the wheel with the axial overlap between the inlet funnel and the fan wheel provided to minimize the amount of air recirculated from the outlet side of the wheel to the inlet side. The door, when opened, permits convenient access to the rotating components for inspection, maintenance, and/or cleaning.

The swing-out tubular fan design includes a vertically-aligned cylindrical or tubular fan casing with a portion of the sidewall so fabricated that it functions as a semi-cylindrical door with one edge of the door hinged to the remaining portion of the fan casing. The fan wheel is mounted on a vertically-aligned shaft on the interior side of the door and the drive motor is mounted on the other side of the door with a 'V' belt and pulley arrangement extending through the door. When the door is in its closed position, the fan wheel is located within the tubular fan casing with the inlet side of the fan wheel aligned with the air inlet bell or funnel. In one exemplary tubular fan design, the door cooperates with a roller and inclined and/or segmented track arrangement but the inlet side of the fan wheel does not axially overlap the inlet funnel when the door is in the closed position to minimize the amount of air recirculated from the outlet side of the fan wheel to the inlet side. The door, when opened, permits convenient access to the rotating components for inspection, maintenance, and/or cleaning.

The performance characteristics of the swing-out fan designs are determined by the size of the fan wheel, the clearance dimensions between the fan wheel and its casing, the amount of power delivered to the fan wheel by the motor, and the amount of backflow or recirculated air from the outlet side of the fan wheel to the inlet side. The recirculation is controlled, in part, by the diameter clearances and axial overlap between the fan wheel and the inlet funnel. In one centrifugal fan wheel design, the fan wheel inlet includes a short cylindrical extension which is formed at a diameter either larger than or smaller than the diameter of the inlet funnel so that the inlet funnel telescopes with respect, that is, axially overlaps, the cylindrical extension to control the recirculation or backflow. The axial overlap and diameter clearances between the fan wheel inlet side and the inlet funnel are limited, in both the swing-out scroll fan and the swing-out tubular fan design, by the hinged nature of the door upon which the rotating components are mounted.

In the swing-out scroll design, points on the inlet side of the fan wheel describe curved paths when the door is opened with the radius of each path being measured from the hinge axis. The respective diameters of the axially overlapping inlet funnel and the inlet side of the fan wheel must be selected such that the fan wheel clears and does not interfere with the inlet funnel when the door is opened. This clearance requirement physically limits the amount of axial overlap on swing-out scroll fan designs. Consequently, fans of this type have a recirculation flow which cannot be conveniently minimized.

In the tubular fan design, the inlet side of the fan wheel moves in a plane parallel to the plane of the inlet funnel when the door is open. In order to provide the axial overlap needed to minimize recirculation or back flow, various mechanical arrangements are provided to lower or telescope the inlet side of the fan wheel with respect to the inlet funnel. These arrangements include, for example, a roller and an inclined and/or segmented track arrangement or screw jack arrangements which lower the fan wheel inlet side relative to the inlet funnel to provide the axial overlap when the door is closed.

The performance characteristics of these types of fans, in addition to being affected by the axial overlap, are not generally susceptible to convenient control or variation; consequently, fans of this type are generally designed to operate at an optimum point rather than over a wide performance range. Occasionally, a need arises for performance control over a much wider range than normally available including stable performance control at reduced air flow rates. Fan performance can be changed, for example, by varying the fan wheel speed. This can be done by providing a variable speed drive motor or, in those fan designs utilizing 'V' belt and pulley transmissions, by changing the respective diameters of the various pulleys. Variable speed drive motors are both complex and expensive, and the removal and substitution of pulleys is a time consuming operation.

When the performance characterstics of a fan are varied, it is possible that the air flow at certain points in the fan, such as the fan wheel impeller blades, can become turbulent or unstable thereby causing undesirable pressure pulsations, the magnitude of which is a complex function of the fan structure and air flow path. Operation of a fan in these unstable regimes, of course, reduces the oerall fan efficiency and subjects the fan structure to unnecessary vibration.

SUMMARY OF THE INVENTION

In view of the above, it is an object of the present invention to provide a fan assembly in which the fan performance characteristics can be efficiently varied over a wide range.

It is another object of the present invention to provide a fan assembly in which the fan performance characteristics can be efficiently varied by changing the inlet air flow conditions.

It is still another object of the present invention to provide a fan assembly in which a change in the inlet air flow characteristics results in a change in the overall fan performance characteristics in a manner which is consistent with the conservation of the energy required to drive the fan wheel.

It is still another object of the present invention to provide a fan assembly in which the performance characteristics may be controlled over a wide range including stable performance control at reduced airflow rates.

It is a further object of the present invention to provide a fan assembly in which the inlet air flow is controlled and altered by an inlet funnel, the position of which can be conveniently varied between a position where the inlet funnel axially overlaps the fan wheel and a retracted position where the funnel is spaced from the fan wheel.

It is still a further object of the present invention to provide swing-out fans, including swing-out fans of the scroll casing type and the tubular casing type, in which the axial overlap between the fan wheel and the inlet funnel can be advantageously controlled and optimized to improve fan efficiency in a manner consistent with the design characterstics of centrifugal fans.

An improved fan construction is provided in which the fan performance characteristics may be varied over a wide range by varying the inlet airflow conditions to the fan wheel. The fan includes a fan wheel mounted in a fan housing and an inlet air duct means located between an inlet side of the fan wheel and a fan housing opening and movable to a selected position between and including a retracted and an extended position. In the retracted position, the duct is spaced away from the inlet air side of the fan wheel to permit a controlled amount of backflow or recirculation between the outlet side of the fan wheel and the inlet side. In the extended position, the duct is positioned such that it axially overlaps the inlet air side of the fan wheel to cause substantially all the inlet air to be directed into the fan wheel.

In the preferred embodiment, the inlet funnel has a converging/diverging venturi shape and is movably connected to a truncated conical base by a linkage assembly. The assembly includes a plurality of links each of which has one end pivoted to the base and the other end pivotally connected to a support ring which is connected to the inlet funnel by struts.

DESCRIPTION OF THE DRAWINGS

The above-description, as well as further objects, features, and advantages of the present invention will be more fully appreciated by reference to the following detailed description of a presently preferred but nonetheless illustrative embodiment in accordance with the present invention when taken in connection with the accompanying drawings wherein.

DESCRIPTION OF THE PREFERRED EMBODIMENT

Figure 1:
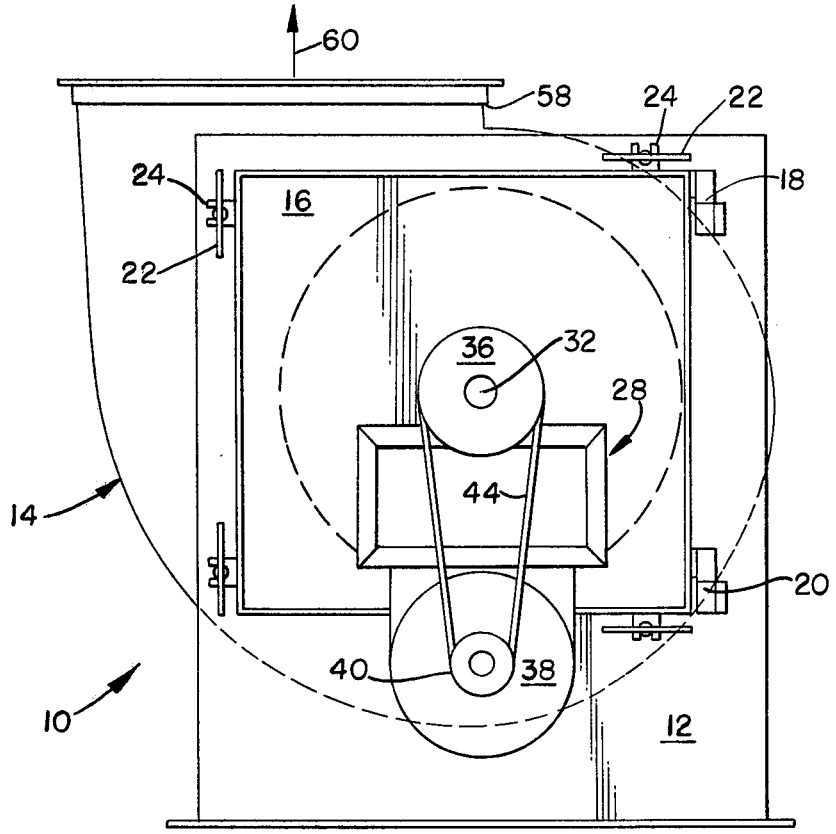
FIG. 1 is a front elevational view of a swing-out scroll casing type fan assembly in accordance with the present invention.
Figure 2:
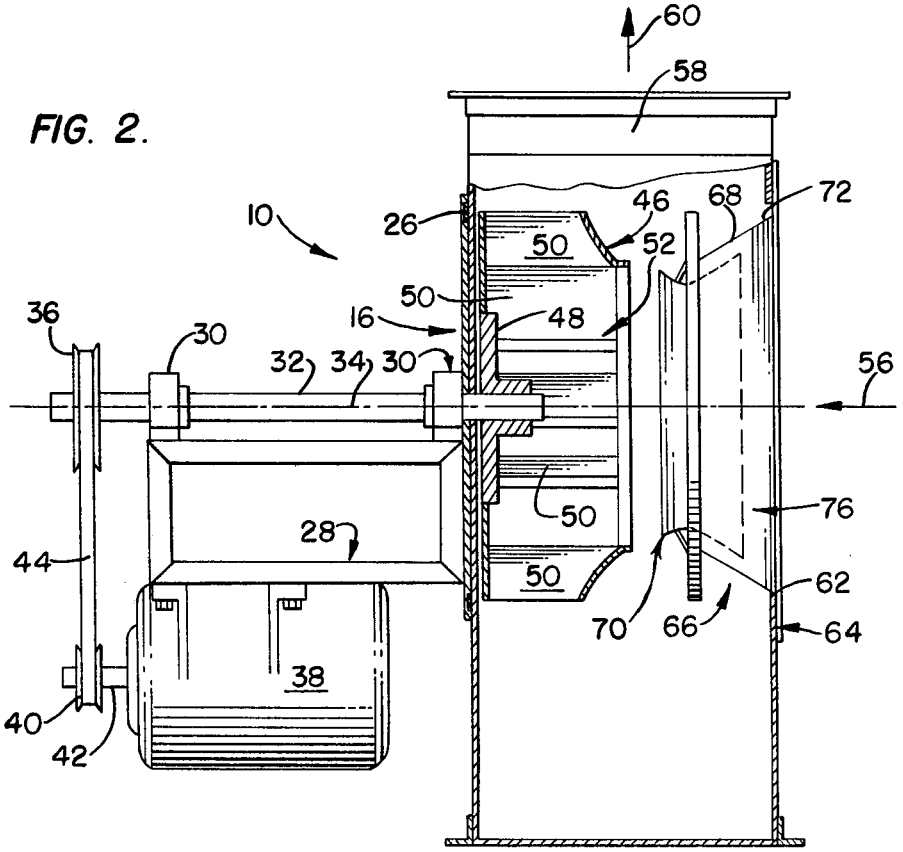
FIG. 2 is a side elevational view, in partial cross section, of the fan assembly shown in FIG. 1 with a retractable inlet funnel shown in a retracted position.
Figure 3:
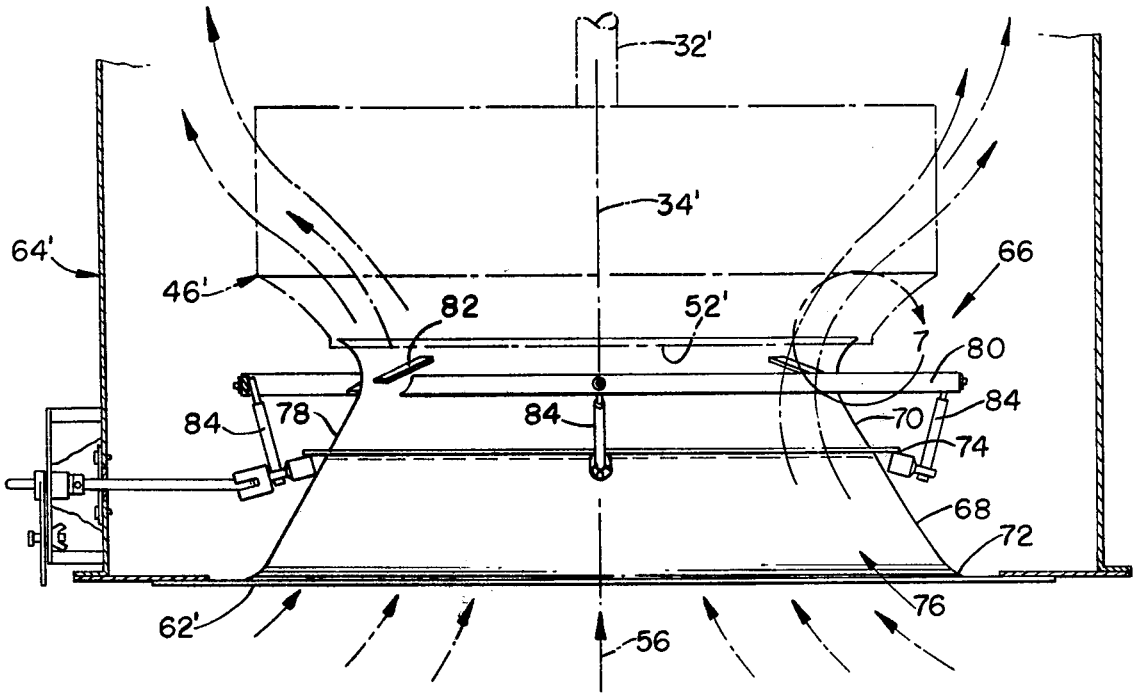
FIG. 3 is a partial elevational view of a tubular casing type fan assembly showing a vertically aligned fan wheel (phantom line illustration) and a retractable inlet funnel in a fully extended position overlapping the inlet side of the fan wheel.
Figure 4:
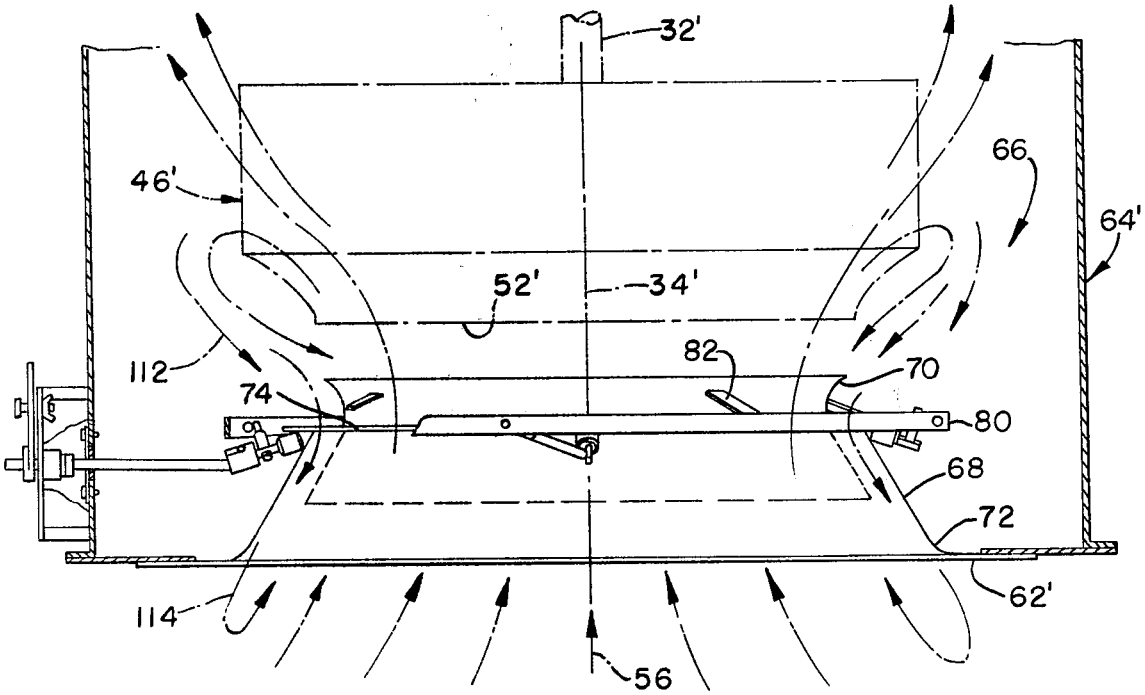
FIG. 4 is an elevational view of the retractable inlet funnel shown in FIG. 3 showing the inlet funnel in a fully retracted position.

A scroll fan design in accordance with the present invention is generally referred in FIGS. 1 and 2 by the reference character 10 and a tubular fan design, also in accordance with the present invention, is generally referred to in FIGS. 3 and 4 by the reference character 10'.

The scroll fan design 10 includes a support panel 12 having a scroll-like or volute-like fan casing 14 secured to one side of the panel and a door 16 which is connected to the other side of the support panel 12 by a pair of hinges 18 and 20. The door 16, which carries various fan rotating components described below, is designed to move between an open and a closed position relative to an opening (not shown) formed through the support panel 12 and is locked or secured in the closed position by a plurality of conventional threaded tie-downs 22 pivotably attached to the support panel 12 and cooperating with bifurcated lugs 24 secured to the edges of the door 16. In the closed position the door compresses a sealing gasket 26 (FIG. 2) located between the door and the support panel 12 to provide a substantially air-tight seal.

A support frame 28, which may be formed from a plurality of welded structural steel angles, is secured to and extends laterally outward from one side of the door 16. Two spaced apart bearing supports 30, each containing a suitable bearing element (not shown), are mounted on the upper side of the support frame 28 and carry a fan shaft 32 adapted to rotate about a substantially horizontal longitudinal-axis 34. One end of the fan shaft 32 extends outwardly from the support frame 28 and carries a 'V' groove pulley 36 at or near its end, and the other end of the fan shaft 32 extends through the door 16 into the fan casing 14. A drive motor 38 is mounted on the lower side of the support frame 28 and has a 'V' groove pulley 40 mounted on its shaft 42 in vertical registration with the pulley 36. A 'V' belt 44 is entrained around both of these pulleys, 36 and 40, such that rotation of the motor 38 is transferred to the fan shaft 32 by the 'V' belt 44. Various structures (not shown) may be provided for adjusting the spacing between the drive motor 38 and the fan shaft 32 to adjust the 'V' belt 44 tension or to permit convenient removal and replacement of the 'V' belt.

A fan wheel 46, which includes a hub 48, a plurality of impeller blades 50, and an inlet opening 52 is secured to the end of the fan shaft 32 extending into the fan casing 14. Rotation of the fan wheel 46 by the drive motor 38 causes air to be drawn into the inlet opening 52 of the fan wheel 46 and discharged from the wheel 46 into the fan casing 14 where it is directed upwardly through the discharge duct 58 in the direction of the discharge arrow 60.

Air is drawn into the fan assembly through an opening 62 formed in an inlet housing 64 and an air inlet duct assembly, generally designated by the reference character 66. The duct assembly 66 includes a cone base 68 and an inlet funnel 70 connected together by a linkage assembly, described in more detail below, that is designed to permit movement of the inlet funnel 70 relative to the inlet opening 52 of the fan wheel 46 between a retracted position (FIG. 2), in which the inlet funnel 70 axially overlaps the inlet opening 52 of the fan wheel 46, and an extended position. The cone base 68, which takes the form of a truncated cone, is formed as a surface of revolution about the fan wheel axis 34 and converges in the direction of inlet air flow from a wide end 72 to a narrow end 74. The wide end 72 of the cone base 68 is secured, as by welding, to the inlet housing 64 in substantial registration with the inlet opening 76. The inlet funnel 70, in the preferred embodiment, is formed as a venturi surface of revolution about the longitudinal axis 34 including a portion 78 which converges to an intermediate narrow portion and a portion which diverges from the narrow portion. The narrow end of the cone base 74 and the converging section 78 of the inlet funnel 70 are dimensioned relative to one another such that the inlet funnel can be telescoped with respect to the cone base 68, that is, telescoped within the cone base as shown in the figures.

In the tubular fan design schematically illustrated in FIGS. 3 and 4, the fan wheel 46' is mounted on a drive shaft 36' for rotation about a vertically-aligned axis 34'. While not specifically shown in the figures, it is understood that the tubular fan design includes a cylindrical, vertically-aligned fan casing 64' with a portion of the casing formed as a semi-cylindrical door that is hinged at one edge to the remaining portion of the casing 64'. A drive motor is mounted on the exterior side of the door with a drive arrangement, such as a 'V' belt and pulley arrangement, extending through the door to the drive shaft 32' upon which the fan wheel 34' is mounted. As in the case of the scroll fan design of FIGS. 1 and 2, air is drawn into the fan wheel 46' through an opening 62' and the air inlet duct assembly 66. The inlet funnel 70 may be moved relative to the inlet opening 52' of the fan wheel 46' along the axis of rotation 34' by the linkage assembly between an extended position (FIG. 3) in which the inlet funnel 70 axially overlaps or telescopes within the inlet side of the fan wheel and a retracted position (FIG. 4) in which the inlet funnel 70 is spaced away from the inlet side of the fan wheel. When the inlet funnel 70 is in the retracted position, the fan wheel 46' is free to move laterally in a plane perpendicular to the axis of rotation 34' (that is, in a plane parallel to the rim of the inlet funnel 70) when the fan casing door is opened.

The linkage assembly, which is shown in detail in FIGS. 3–6, includes a support ring 80, struts 82, and pivotable links 84 and provides support for the inlet funnel 70. The linkage assembly permits movement of the inlet funnel 70 to a selected position between and including the extended position and the retracted position. The support ring 80, which is concentric with and spaced outwardly from the inlet funnel 70, is connected to the inlet funnel 70 by a plurality of radially aligned struts 82 each having one end secured to the support ring 80 and the other end thereof secured to the inlet funnel 70. The pivotable links 84 extend between and connect the support ring 80 and the cone base 68. Each link 84 has one end pivotably connected to the support ring 80 with the other end pivotably connected to the cone base 68 and are so pivoted that rotation of the links 84 relative to their pivoting axes will cause the inlet funnel 70 to move or displace along the longitudinal axis 34 relative to the cone base 68 and the inlet opening 52 of the fan wheel 46.

Figure 5:
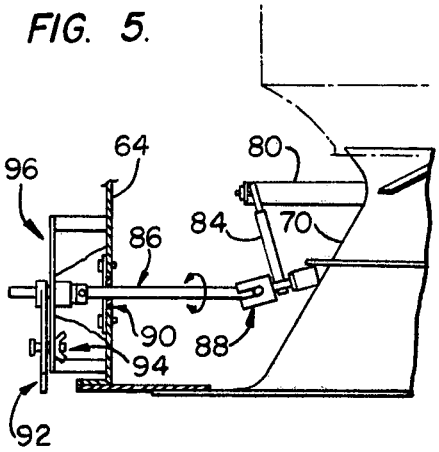
FIG. 5 is a side elevational view of an adjusting assembly to selectively adjust the position of the inlet funnel relative the fan wheel.
Figure 6:
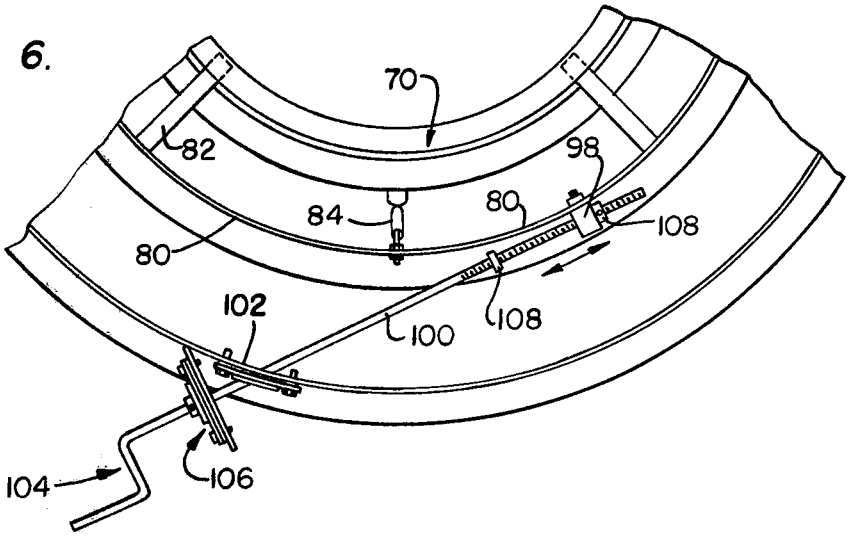
FIG. 6 is a side elevational view of another embodiment of an adjusting assembly which may also be used to selectively adjust the position of the inlet funnel relative the fan wheel.

The inlet funnel 70 may be moved to a desired position by any one of a plurality of different means including a torque shaft assembly shown in FIGS. 3, 4, and 5 and a lead screw/nut assembly shown in FIG. 6.

The torque shaft assembly includes a shaft 86 coupled to one end of a link 84 by a universal-type joint 88. The other end of the torque shaft extends through a sealing element 90 located in the inlet housing 64 wall and terminates in a control handle 92 and handle lock 94. The position of the inlet funnel 70 relative to the inlet opening 52 of the fan wheel may be adjusted by rotating the control handle 92 to apply a torque to the link 84, which then pivots to cause the inlet funnel 70 to advance or retract to the desired position. The handle 92 may then be secured to a backing plate 96 by the threaded locking member 94.

The lead screw/nut assembly includes a threaded nut 98 pivotably connected to the support ring 80 and a threaded lead screw 100 which engages the nut and which extends outwardly of the housing through a sealing element 102. The exterior end of the lead screw 100 is formed as a handle 104 and is rotatably supported in a bearing and lock assembly 106. To adjust the position of the inlet funnel 70 the handle 104 is rotated to apply a tangential force through the nut 98 to the support ring 80 to thereby cause the links 84 to pivot until the inlet funnel 70 is advanced or retracted to the desired position. After the inlet funnel is adjusted, the handle 104 may be locked in place by suitable locking means. Limit stops 108 may be located on the lead screw 100 to define the extended and retracted limits of the inlet funnel 70.

Figure 7:
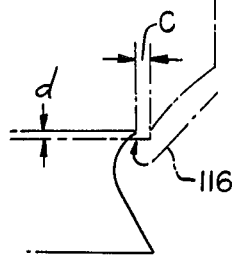
FIG. 7 is an enlarged detail view of the encircled portion of the fan wheel and inlet funnel of FIG. 3 showing the inlet funnel axially overlapping the fan wheel.

In FIG. 3 the inlet funnel 70 has been moved to its fully extended position with the diverging portion of the funnel 70 axially overlapping or overlaying the inlet side 52 of the fan wheel 46 by an amount "d" as shown in the enlarged detail view of FIG. 7. The overlap assists in maximizing the amount of inlet air transferred to the fan wheel 46 to improve the overall fan efficiency. In the disclosed embodiment, the fan wheel inlet side diameter is formed larger than the rim of the diverging portion of the inlet funnel 70 such that the inlet funnel can fit or telescope within the fan wheel inlet with the diameter clearance between these two parts represented by an amount "c" in FIG. 7. As can be appreciated by those skilled in the art, the diameter of the rim of the diverging portion of the inlet side of the fan wheel such that the inlet funnel can fit over or telescope over the fan wheel inlet.

In FIG. 4, the inlet funnel 70 is shown in its retracted position in which the diverging portion of the inlet funnel 70 is spaced away from the inlet side 52 of the fan wheel 46. In this position, a portion of the air from the outlet side of the fan wheel is recirculated to the inlet side of the fan wheel. The recirculation or backflow decreases the static pressure produced by the fan as measured between the inlet and outlet sides of the fan wheel and reduces the amount of drive power which must be inputted to the fan wheel.

Figure 8:
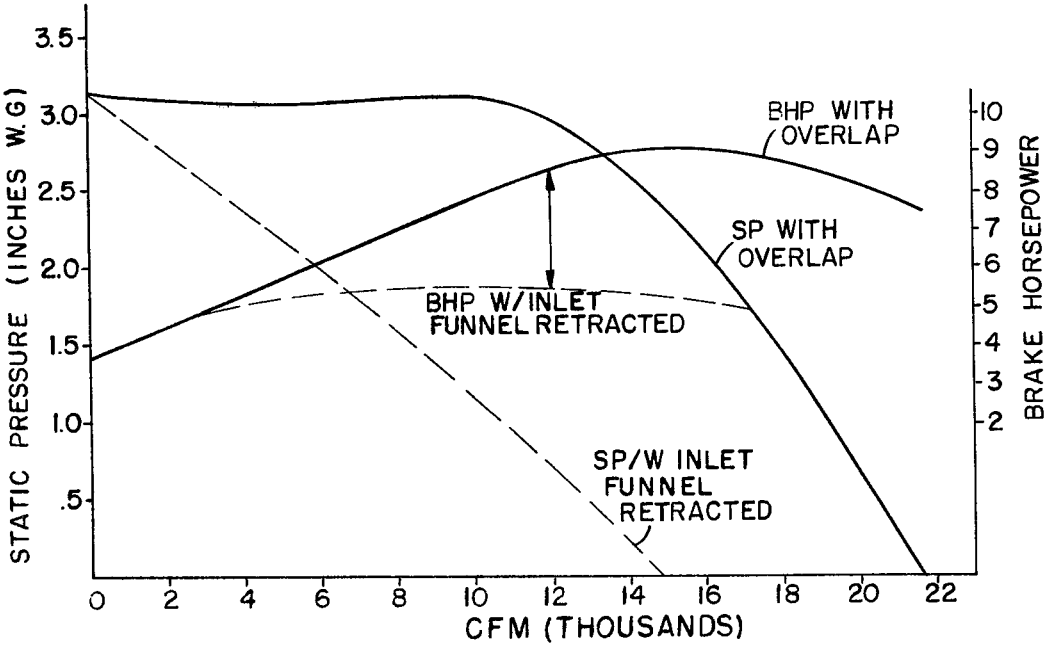
FIG. 8 is a graphical illustration of the fan performance characteristics with the inlet funnel in its extended and retracted positions in which the horizontal axis (abscissa) represents cubic feet per minute, the left vertical axis (left ordinate) represents static pressure in inches of water and the right vertical axis (right ordinate) represents the brake horsepower required to drive the fan wheel.

The fan assembly of the present invention permits convenient control of a number of fan performance parameters as graphically illustrated in FIG. 8, which shows the variation in fan static pressure (SP) and brake horsepower (BHP) at various flow rates (CFM) for both the extended or overlapping position (solid lines) and the retracted position (dotted line) for an exemplary fan. When the fan inlet 70 is in its fully extended position, as shown in FIG. 3, the diverging portion of the inlet funnel 70 extends within and axially overlaps the inlet side of the fan wheel 46. In this extended position, substantially all the inlet air is directed to the fan wheel 46 to provide the fan performance characteristics represented by the solid lines of FIG. 8. As shown therein, the static pressure (SP) remains relatively constant up to approximately 11,000 CFM with the brake horsepower (BHP) required to drive the fan wheel increasing with increasing flow rates. When it is desired to vary fan performance, the inlet funnel 70 may be retracted away from the inlet opening 52 of the fan wheel 46 causing a partial recirculation or backflow of the outlet air through the inlet side of the fan wheel and through the inlet opening of the fan housing as shown, respectively, by the arrows 112 and 114 of FIG. 4. As shown in the graph, the static pressure and CFM delivered to an external system can be reduced by retracting the inlet funnel. At the same time, the brake horsepower required to drive the fan wheel remains relatively constant at a lower magnitude than that required when the inlet funnel is in its fully extended position. As can be seen, the present invention permits control of the fan static pressure for various flow rates over a wide range with an attendant decrease in the brake horsepower required to drive the fan wheel. This reduction in brake horsepower is significant, of course, from the standpoint of energy conservation. In addition, the adjustable nature of the funnel permits the convenient selection of stable fan operating points to thereby avoid the problems associated with air flow turbulence.

In conventional swing-out scroll-type fan design, a clearance dimension "c" (FIG. 7) exists between the respective diameters of the diverging portion of the inlet funnel and the inlet side of the fan wheel to prevent interference between the rim portions of these two components when the door is pivoted to its open position. This diameter clearance, while necessary to maintain the functional advantages of the swing-out scroll-type design, diminishes the overall fan efficiency somewhat by permitting some of the air from the outlet side of the fan wheel to be recirculated to the inlet side through the diameter clearance as indicated by the broken line arrow 116 in FIG. 7. The retractable nature of the inlet funnel of the present invention permits the clearance dimension between the inlet funnel and the inlet side of the fan wheel to be reduced to diminish the amount of recirculated air and thereby increase the overall fan efficiency when the inlet funnel is in its fully extended position. When it is desired to open the door carrying the rotating fan components, the inlet funnel is merely retracted away from the inlet wheel and the door opened. Because of the retractable nature of the inlet funnel, the clearance may be made smaller, the fan inlet efficiency increased, and the functional advantages of the swing-out scroll design retained.

In conventional swing-out tubular-type fan designs, a mechanical arrangement, for example, a roller and inclined and/or segmented track arrangement may be provided to give a clearance gap between the inlet side of the fan wheel and the inlet funnel. This results in reduced performance. The retractable nature of the inlet funnel of the present invention permits the axial overlap to be accomplished by merely extending the inlet funnel after the door carrying the rotating components is closed and the fan operating characteristics may be conveniently controlled.

While the present invention has been described above in the context of a scroll-like fan design and a tubular casing fan design, it is to be understood that the present invention is not limited to these two fan designs and is suitable for use with other types of centrifugal fan designs or arrangements as well as various air handling systems.

As is apparent to those skilled in the art, various changes and modifications may be made to the fan assembly of the present invention without departing from the spirit and scope of the present invention as recited in the appended claims as their legal equivalent.

What is claimed is:

1. A fan construction comprising:

a fan housing having an air inlet opening;

a fan wheel mounted in said housing for rotation about a fan wheel axis relative to said housing, said wheel having at least one inlet side through which inlet air is admitted to said fan wheel;

inlet air duct means located between said wheel inlet opening and said housing inlet opening, said duct means movable to a selected position relative to said wheel inlet side between and including a retracted position where said duct means is spaced from said wheel inlet side and an extended position where said duct axially overlaps said fan wheel inlet side; said inlet air duct means including a first duct located at said housing inlet opening and a second duct located intermediate said first duct and said inlet side of said fan wheel and movable between said retracted and extended positions;

moving means connected between said first and second ducts to effect movement of said second duct relative to said first duct and said inlet side of said fan wheel, said moving means including a support ring for supporting said second duct; a plurality of struts secured to and extending between said second duct and said support ring; a plurality of links connecting said support ring and said first duct, each of said links having one end pivotably connected to said support ring and the other end pivotably connected to said first duct; and means for pivoting said links relative to their pivoting axes to cause said second duct to displace along said fan wheel axis.

2. A fan construction comprising:

a fan housing having an air inlet opening;

a door pivotably connected to said fan housing;

a fan wheel having an air inlet side mounted on said door for rotation about a fan wheel axis;

said fan wheel positioned in said fan housing when said door is in a closed position;

inlet air duct means located between said wheel inlet side and said housing inlet opening, said duct means movable to a selected position relative to said wheel inlet side between and including a retracted position where said duct means is spaced from said wheel inlet opening and an extended position where said duct axially overlaps said fan wheel inlet side; said inlet air duct means including a first duct located at said housing inlet opening and a second duct located intermediate said first duct and said inlet side of said fan wheel and movable between said retracted and extended positions;

moving means connected between said first and second ducts to effect movement of said second cut relative to said first duct and said inlet side of said fan wheel, said moving means including a support ring for supporting said second duct; a plurality of struts secured to and extending between said second duct and said support ring; a plurality of links connecting said support ring and said first duct, each of said links having one end pivotably connected to said support ring and the other end pivotably connected to said first duct; and means for pivoting said links relative to their pivoting axes to cause said second duct to displace along said fan wheel axis.

3. The fan construction claimed in claims 1 or 2, wherein said second duct is formed as a venturi having, in the direction of inlet air flow, a first portion converging to a narrow portion and a second portion diverging from said narrow portion.

4. The fan construction claimed in claims 1 or 2, wherein said axis is substantially horizontal.

5. The fan construction claimed in claims 1 or 2, wherein said fan axis is substantially vertical.

6. The fan construction claimed in claims 1 or 2, wherein said first duct is formed as a truncated cone which converges, in the direction of inlet air flow, from a wide end to a narrow end.

7. The fan construction claimed in claim 6, wherein said second duct is formed as a venturi having, in the direction of inlet air flow, a first portion converging to a narrow portion and a second portion diverging from said narrow portion.

8. The fan construction claimed in claim 7, wherein said converging portion of said second duct is adapted to fit within and telescope relative said narrow end of said first duct.

9. The fan construction claimed in claims 1 or 2, wherein said means for pivoting said links relative to their pivoting axes comprises:

means for applying a torque to at least one of said links.

10. The fan construction claimed in claim 9, wherein said torque applying means includes a shaft connected to one end of at least one of said pivotable links and adapted to be rotated to apply said torque to said link.

11. The fan construction claimed in claims 1 or 2, wherein said means for pivoting said links relative to their pivoting axes to cause said second duct to displace along said fan wheel axes comprises:

means to apply a tangentially directed force to said support ring.

12. The fan construction claimed in claim 11, wherein said means to apply said tangetial force comprises:

a threaded nut coupled to said support ring and a threaded lead screw engaging said nut, whereby rotation of said lead screw relative to said nut causes a tangential force to be directed against said support ring.

13. The fan construction claimed in claims 1 or 2 wherein:

said first and second ducts are formed as surfaces of revolution about said fan wheel axis.

* * * * *